US009821327B2

(12) United States Patent
Lin et al.

(10) Patent No.: US 9,821,327 B2
(45) Date of Patent: Nov. 21, 2017

(54) WATER OUTLET DEVICE WITH ROTARY OUTLET FUNCTION AND A WATER OUTLET DEVICE WITH DIFFERENT WATER OUTLET MEANS OF FUNCTION

(71) Applicant: FUJIAN XIHE SANITARY WARE TECHNOLOGY CO., LTD., Nan'an, Fujian (CN)

(72) Inventors: Xiaofa Lin, Nan'an (CN); Xiaoshan Lin, Nan'an (CN); Qiqiao Liu, Nan'an (CN); Xiaoqing Deng, Nan'an (CN); Caibo Gu, Nan'an (CN)

(73) Assignee: FUJIAN XIHE SANITARY WARE TECHNOLOGY CO., LTD., Nan'an (CN)

( * ) Notice: Subject to any disclaimer, the term of this patent is extended or adjusted under 35 U.S.C. 154(b) by 0 days.

(21) Appl. No.: 15/015,888

(22) Filed: Feb. 4, 2016

(65) Prior Publication Data

US 2016/0228887 A1 Aug. 11, 2016

(30) Foreign Application Priority Data

Feb. 11, 2015 (CN) ..... 2015 1 0071745

(51) Int. Cl.
*B05B 1/18* (2006.01)
*B05B 3/04* (2006.01)

(52) U.S. Cl.
CPC ..... *B05B 1/185* (2013.01); *B05B 3/0418* (2013.01); *B05B 3/0463* (2013.01); *B05B 1/18* (2013.01)

(58) Field of Classification Search
CPC .. B05B 1/18; B05B 1/185; B05B 3/04; B05B 3/0409; B05B 3/0418; B05B 3/0422; B05B 3/0445; B05B 3/0463
USPC ..... 239/237, 240, 263.3, 264, 380, 381
See application file for complete search history.

(56) References Cited

U.S. PATENT DOCUMENTS 4,802,628 A * 2/1989 Dautel ..... B05B 3/0463 239/227
6,360,967 B1 * 3/2002 Schorn ..... B05B 3/0463 239/240
7,278,591 B2 * 10/2007 Clearman ..... B05B 1/185 239/214

(Continued)

FOREIGN PATENT DOCUMENTS

CN 2794647 Y 7/2006
CN 1891347 A 1/2007
CN 201988467 U 9/2011

*Primary Examiner* — Darren W Gorman
(74) *Attorney, Agent, or Firm* — Rabin & Berdo, P.C.

(57) ABSTRACT

A water outlet device with rotary outlet function has a fixing part, a driving mechanism, a control mechanism, at least two sliding units and several water outlet nozzles, the water outlet nozzles are movably connected to the fixing part, the sliding unit can slide with respect to the fixing part; the driving mechanism can be driven by the water flow pressure, at least two sliding units are connected with the driving mechanism and driven by the driving mechanism to drive, and at least two sliding units are communicated with the water outlet nozzles in rotary manner around the rotating axis by intersection way. The control mechanism is connected with the driving mechanism and at least two sliding units to control at least one of sliding units to slide, the sliding action of the sliding units connected to the water outlet nozzles cause the water outlet nozzles to move.

17 Claims, 11 Drawing Sheets

(56) References Cited

U.S. PATENT DOCUMENTS

| | | | | |
|---|---|---|---|---|
| 2008/0223957 | A1* | 9/2008 | Schorn | B05B 1/185<br>239/428.5 |
| 2011/0210189 | A1* | 9/2011 | Chen | B05B 1/14<br>239/214 |
| 2014/0008462 | A1* | 1/2014 | Gransow | B05B 1/18<br>239/391 |

* cited by examiner

WATER OUTLET DEVICE WITH ROTARY OUTLET FUNCTION AND A WATER OUTLET DEVICE WITH DIFFERENT WATER OUTLET MEANS OF FUNCTION

FIELD OF THE INVENTION

The present invention relates to a water outlet device, especially to A water outlet device with rotary outlet function and a water outlet device with different water outlet means of function.

BACKGROUND OF THE INVENTION

The existing shower with the same kind or same group outlet hole in the market normally can perform only one function, such as shower spray, regular massage spray, bubble spray, nebulization spray and so on like ordinary several water outlet function; but only one water outlet function can't satisfy the market requirement nowadays, therefore, some researching staff has developed a multi-functional water outlet device in switch manner resulted in the communication between different water cavity with different water outlet holes, in which manner there are several disadvantages existing: 1. types of the water outlet result is limited; 2. occupy more space for additional components assembly to accomplish more function by more outlet holes, in which manner can't satisfy the needs for designing of simple and compact structure with many kinds of outlet function; 3. the outlet functional effect will be limited by the space limitation; conclusion as above, present water outlet device can only perform different water outlet function in the waterway switch way in cooperation with different outlet holes, but can't make it by same groups or same kind of outlet holes.

SUMMARY OF THE INVENTION

The object of the present invention is to overcome the disadvantages of the existing known technology and to provide a water outlet device with different outlet functions and a water outlet device with rotary outlet function, the present invention has advantages of space-saving and function-maximization with a fine and ingenious structure to achieve the function of massage water spray with 360 degree rotation and simple pendulum massaging water spray in switch manner, meanwhile with water saving function in the space and accomplishing different effect of water outlet with same or different groups of outlet holes.

One technical solution to the above technical problems for the present invention is that:

A water outlet device with rotary outlet function, wherein comprising a fixing part, a driving mechanism, at least two sliding units and several water outlet nozzles, the water outlet nozzles are movably connected to the fixing part, the sliding unit can slide with respect to the fixing part; the driving mechanism can be driven by the water flow pressure, at least two sliding units are connected with the driving mechanism in transmission way and driven by the driving mechanism to drive, and at least two sliding units are communicated with the water outlet nozzles in rotary manner around the rotating axis in intersection way.

In another preferred embodiment, the two sliding units include respective surfaces facing and in direct sliding contact with each other, the sliding unit, for each water outlet nozzle, has a sliding groove (opening) in an upper portion of which the water outlet nozzle is movably assembled in the openings, and the two sliding units are driven to slide in different directions such that the water outlet nozzles are driven to rotate by the sliding of at least one of the two sliding units.

In another preferred embodiment, the fixing part is disposed with an assembly structure, the water outlet nozzle is provided with a spherical surface cooperated to the assembly structure in the purpose of supporting the water outlet nozzles to rotate in omni-direction.

In another preferred embodiment, the sliding units are parallelly arranged and with each other's sliding direction intersected vertically by different surface.

In another preferred embodiment, further comprises two stop ribs located on both sliding units external side for guiding the sliding direction of the sliding units.

In another preferred embodiment, the driving mechanism comprises an impeller provided with an eccentric shaft penetrating at least two sliding units and in movable connection with the sliding units; under the impact of water flow the rotation of the impeller drives the eccentric shaft rotate, and urges at least two sliding units coupled with the eccentric shaft to slide as well.

In another preferred embodiment, the sliding units are both disposed with a long annular location hole to locate the eccentric shaft, by which rotation will drive the sliding units to slide.

Another technical solution to the above technical problems for the present invention is that:

A water outlet device with different water outlet means of function, wherein comprising a fixing part, a driving mechanism, at least two sliding units, several water outlet nozzles and a control mechanism, said water outlet nozzles are movably connected to the fixing part, the sliding units can slide with respect to the fixing part; the driving mechanism can be driven by the water flow pressure, the control mechanism is connected with the driving mechanism and at least two sliding units in transmission way to control at least one of sliding units to slide, the sliding action of the sliding units connected to the water outlet nozzles in transmission manner will activate the water outlet nozzles to move, then different activity of the water outlet nozzles will make different outlet function in the condition of different quantity of the sliding units taking sliding action.

In another preferred embodiment, the control mechanism controls one of the sliding units or both together to take sliding action, the water outlet nozzles are activated to swing when one of sliding units takes sliding action, while in the condition of both sliding units taking sliding action together, the water outlet nozzles are activated to rotate around the rotary axis in the manner of the water outlet nozzles intersecting with the rotary axis as the consequence of the sliding action taken by the two sliding units.

In another preferred embodiment, said at least two sliding units are communicated with each other by different surface in intersection way, the sliding unit is provided with a slide groove; the upper portion of the water outlet nozzle is movably assembled in the sliding groove of said at least two sliding units, through which assembly to drive the water outlet nozzles rotate by the effect of different sliding direction of said at least two sliding units.

In another preferred embodiment, the fixing part is disposed with an assembly structure, the water outlet nozzle is provided with a spherical surface cooperated to the assembly structure in the purpose of supporting the water outlet nozzles to rotate in omni-direction; said water outlet nozzle is provided with a nozzle body including an inlet hole and an outlet hole; said spherical surface is positioned in the middle of the nozzle body; on the external wall of the nozzle body nearby inlet hole is disposed with two connecting sleeves which are coupled with two of the sliding units respectively.

In another preferred embodiment, the sliding units are arranged parallelly and with each other's sliding direction intersected vertically by different surface.

In another preferred embodiment, further comprises two stop ribs located on both sliding units external side for guiding the sliding direction of the sliding units.

In another preferred embodiment, the driving mechanism comprises an impeller provided with an eccentric shaft penetrating at least two sliding units and in movable connection with the sliding units; under the impact of water flow the rotation of the impeller drives the eccentric shaft rotate, and urges at least two sliding units coupled with the eccentric shaft to slide as well.

In another preferred embodiment, the sliding units are both disposed with a long annular location hole to locate the eccentric shaft, by which rotation will drive the sliding units to slide.

In another preferred embodiment, the eccentric shaft comprises two separating parts: a fixed connection part and a movable eccentric unit which are cooperated to the first sliding unit and the second sliding unit respectively, said control mechanism controls the action of separation or connection between the fixed connection part and the movable eccentric unit to drive the first sliding unit slide independently or the first and the second sliding units slide together by the eccentric shaft.

In another preferred embodiment, the control mechanism comprises a coupling part set on the end surface of the fixed connection part and a matching part set on one end of the movable eccentric unit, the coupling part and the matching part is cooperated with each other as to control the action of connection or separation between the fixed connection part and the movable eccentric unit when the coupling part is coupled with the matching part or detached from it.

In another preferred embodiment, said control mechanism is provided with a rotating part, a pivot part which is cooperated with the rotating part and movably connected to the movable eccentric unit, and a spring set between the movable eccentric unit and the impeller; therein, the rotating part will jack up the pivot part to drive the movable eccentric unit displace, then the spring will be compressed and the coupling part will be pushed to connect with the matching part located on the movable eccentric unit when the rotating part is rotated towards the first direction, while towards the second direction, the spring resile to its original place then result in pushing the pivot part reset and urge the coupling part to be separated from the matching part located on the movable eccentric unit.

In another preferred embodiment, on the upper surface of the rotating part is disposed with a convex part with guiding oblique surface; a bone piece set on the pivot part is cooperated to the guiding oblique surface of the convex part to drive the rotating part to jack up the pivot part.

In another preferred embodiment, the water outlet nozzle is provided with a nozzle body including an inlet hole and an outlet hole; said spherical surface is positioned in the middle of the nozzle body; on the external wall of the nozzle body nearby inlet hole is disposed with two connecting sleeves which are coupled with two of the sliding units respectively A third technical solution to the above technical problems for the present invention is that:

A shower, comprising the above mentioned water outlet device and outlet cover, the outlet cover is formed as a part of a fixing part which includes an inlet waterway connected to the water outlet nozzle.

In another preferred embodiment, the fixing part is provided with a supporting plate and a nozzle cover which are both located in the outlet cover; the assembly between the supporting plate and the nozzle cover makes a cavity formed to locate the sliding units.

Comparing to the existing known technology, the technical solution of the present invention has advantages as follows:

1. By the way of urging at least two sliding units to slide in purpose of driving the water outlet nozzles rotate around the rotating axis in intersection way, the function of massage water spray with 360 degree rotation is accomplished by simple structure of small volume characterized with the advantages of space-saving and function-maximization compared to the traditional structure.
2. In the method of making the control mechanism connected with the driving mechanism and at least two sliding units in transmission way to control at least one of sliding units to slide, and by the way of making the sliding units connected to the water outlet nozzles in transmission manner to activate the water outlet nozzles by sliding action of the sliding units, the different outlet function of the water outlet nozzle is performed as the consequence of different quantity of the sliding units taking sliding action by control, it's space-saving to accomplish two kinds or more than two kinds of water outlet effect by the design of a fine and ingenious structure.
3. By means of making the control mechanism control one of the sliding units or both together to take sliding action, the water outlet nozzles are activated to swing when one of sliding units takes sliding action, while in the condition of both sliding units taking sliding action together, the water outlet nozzles are activated to rotate around the rotary axis in the manner of the water outlet nozzles intersecting with the rotary axis as the consequence of the sliding action taken by the two sliding units, it's convenient and practical by easy operation and with promising prospect of future market.
4. The present invention is simple in structure, easy to realize, the element is easy to manufacture and a large cost savings compared with the prior conventional structure, at the same time, the design of present invention can provide a relatively large space for other functions being implemented and further development of the product, not only to solve the technical problem of achieving 360 degree rotation spray of the massage shower to cater for the developing trend of existing market, but also break up the limitation generated by existing single water outlet function as well as with high market value and market prospect.

DETAILED DESCRIPTION OF THE EMBODIMENTS

Figure 1:
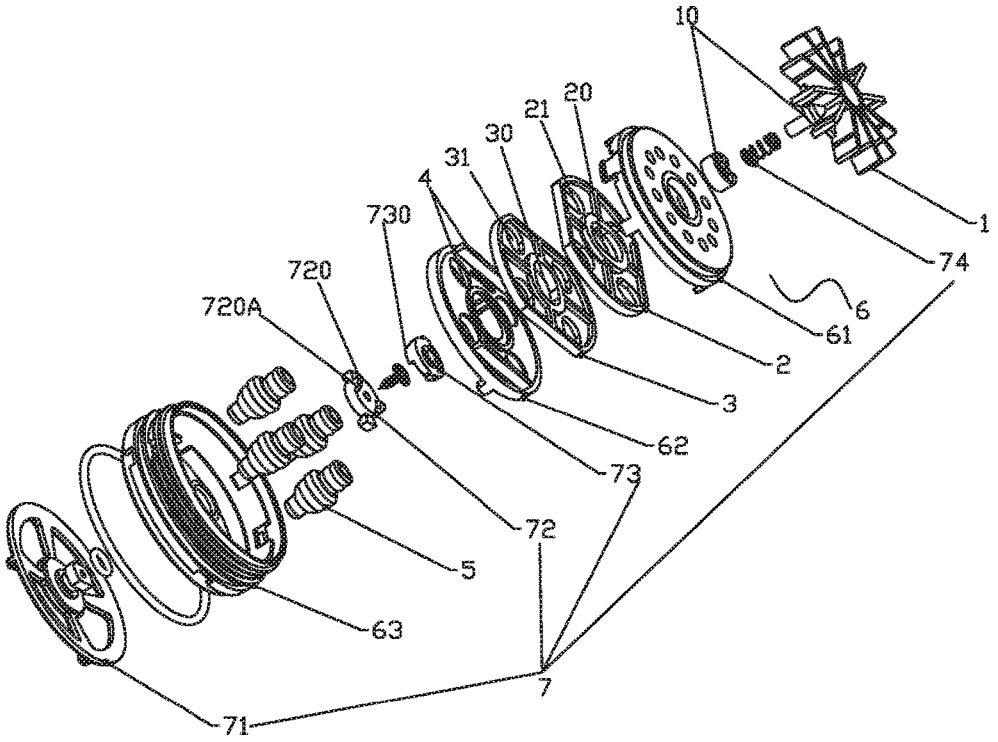
FIG. 1 illustrates an exploded and schematic diagram of the water outlet device of the present invention.
Figure 2:
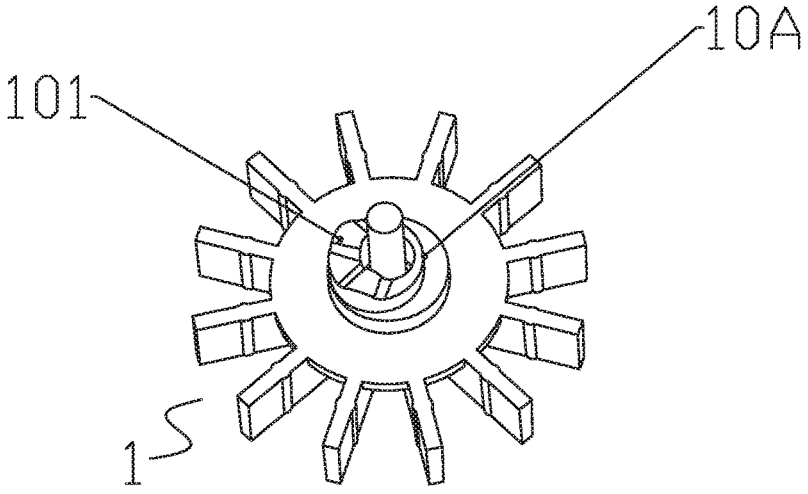
FIG. 2 illustrates a schematic diagram of an impeller of the present invention.
Figure 3:
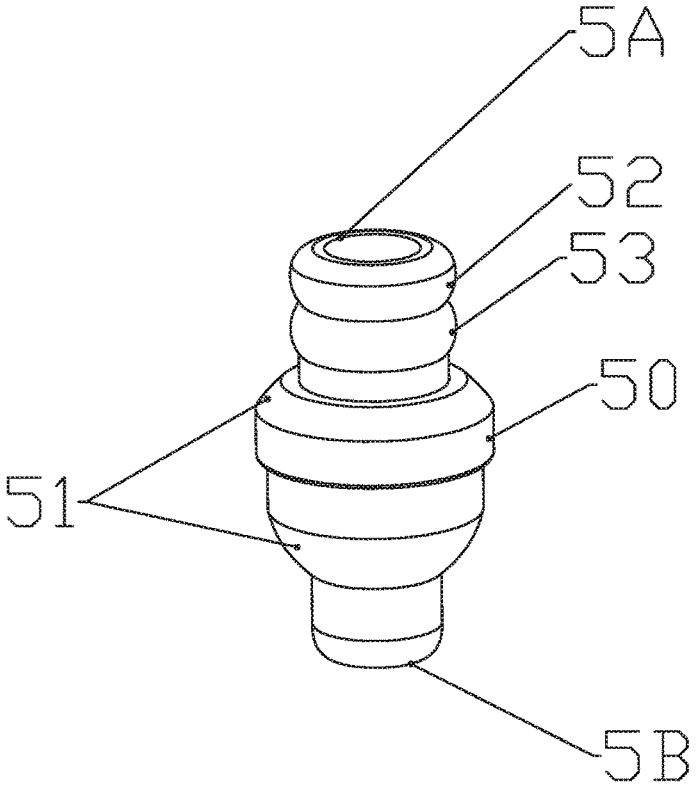
FIG. 3 illustrates a schematic diagram of the water outlet nozzle of the present invention.
Figure 4:
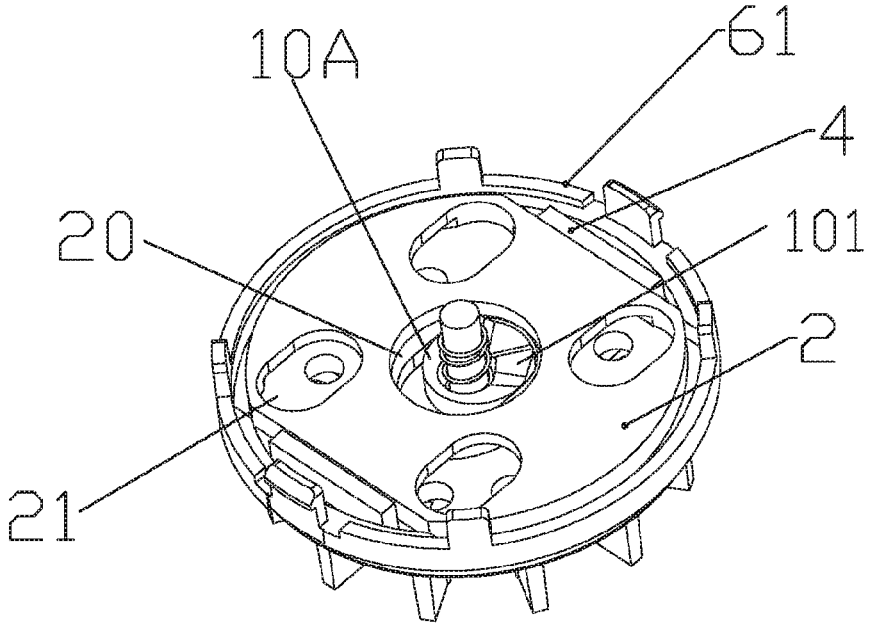
FIG. 4 illustrates a schematic diagram of the first sliding unit assembled to the support plate of the present invention.
Figure 5:
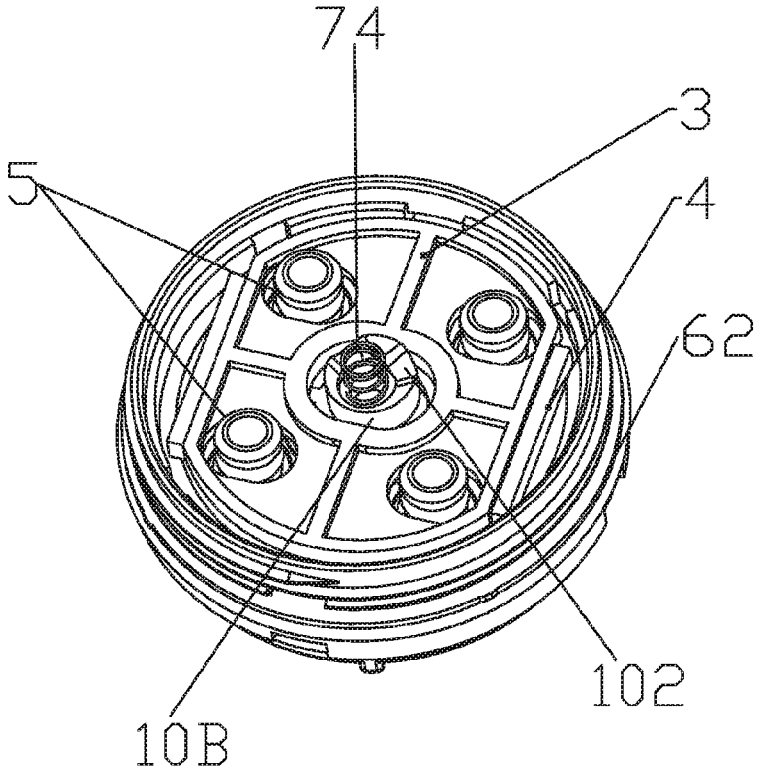
FIG. 5 illustrates a schematic diagram of the second sliding unit assembled to outlet cover of the present invention.

The present invention will be further described with the drawings and the embodiments to make the present invention more clear and well-known. It should be noted that, the embodiments of the present invention is used to describe the present invention but not to limit the scope of the present invention.

Please referring to FIGS. 1~5, a water outlet device with different water outlet means of the present invention comprises a fixing part 6, a driving mechanism, at least two sliding units 2, 3, a plurality of water outlet nozzles 5 and a control mechanism 7.

The fixing part 6 is disposed with an assembly structure, the water outlet nozzle 5 is provided with a spherical surface 51 that cooperates with the assembly structure for the purpose of supporting the water outlet nozzle 5 to rotate omnidirectionally. The driving mechanism comprises an impeller 1 provided with an eccentric shaft 10. The impeller 1 will take rotation under the impact of water flow. The sliding units 2,3 are arranged parallelly and both can slide with respect to the fixing part 6 with each other's sliding direction intersected vertically by a different surface.

the control mechanism controls one of the sliding units or both together to take sliding action. In the method of making the control mechanism connected with the driving mechanism and at least two sliding units 2,3 in transmission way to control at least one of sliding units 2,3 to slide, the sliding units 2,3 are connected to the water outlet nozzle 5 in transmission manner to activate the water outlet nozzle 5, then different activity of the water outlet nozzles 5 will make different outlet function in the condition of different quantity of the sliding units 2,3 taking sliding action. For example, the control mechanism controls one of the sliding units 2,3 or both sliding units 2,3 together to take sliding action, one condition is that the water outlet nozzle 5 is activated to swing left and right or forward and backward when one of sliding units 2,3 takes sliding action, while in the condition of both sliding units 2,3 taking sliding action together, the water outlet nozzle 5 is activated to rotate around the rotary axis in the manner of the water outlet nozzle 5 intersecting with the rotary axis as the consequence of the sliding action taken by the two sliding units 2,3. In a better way, the external side of the two sliding units 2,3 are disposed with stop rib 4 to limiting the sliding range of the sliding units. In the embodiment of present invention, certain sliding way can be designed by needs like the first sliding unit can be designed to swing left and right while the second sliding unit in forward and backward sliding way.

Multiple sliding grooves (openings) 21,31 and location holes 20,30 located on the two sliding units 2,3 that cooperate with the water outlet nozzle 5 and the eccentric shaft 10 respectively. The sliding grooves 21,31 and location holes 20,30 are designed of long annular shape with the direction of the longer end vertical to the stop rib 4 correspondingly. In a better way, the long annular grooves 21,31 and location holes 20,30 are designed in rectangular shape and both with a semi-circular position-providing part which is extended out from the short flap of the rectangle; meanwhile, the movement of both sides of short ends of the long annular grooves 21,31 and location holes 20,30 that cooperate with the water outlet nozzle 5 and the eccentric shaft 10 respectively while the long end forming position-providing part.

The eccentric shaft 10 penetrating at least two sliding units 2,3 is in movable connection with the sliding units 2,3, under the impact of water flow the rotation of the impeller 1 drives the eccentric shaft 10 rotate, and urges at least two sliding units 2,3 coupled with the eccentric shaft 10 to slide in staggered way as well. In specified structure: the rotation of the eccentric shaft 10 positioned in the location hole 20,30 urges the sliding units 2,3 to slide in stagger way.

The water outlet nozzle 5 is provided with a nozzle body 50 including an inlet hole 5A and an outlet hole 5B; spherical surface 51 is positioned in the middle of the nozzle body 50; on the external wall of the nozzle body 50 nearby inlet hole 5A is disposed with two connecting sleeves 52,53 which are coupled with two of the sliding units 2,3 respectively. The connecting sleeves 52,53 set on the upper end on the water outlet nozzle 5 is in movable connection in the groove 21,31 of the sliding units 2,3 in order to perform circumferential displacement urged by the sliding movement of the sliding units 2,3 in opposite direction, then drive the water outlet nozzle 5 rotate consequently. The fixing part includes a body part which is provided with a supporting plate 61 and a nozzle cover 62 which are both located in the outlet cover 63; the assembly between the supporting plate 61 and the nozzle cover 62 makes a cavity formed to locate the sliding units 2,3; the stop ribs 4 are assembled both on the supporting plate 61 and the nozzle cover 62; the spherical surface 51 is set between the nozzle cover 62 and the outlet cover 63.

In the specified structure: the eccentric shaft 10 comprises two separating parts: a fixed connection part 10A and a movable eccentric unit 10B which are cooperated to the first sliding unit 2 and the second sliding unit 3 respectively, the control mechanism controls the action of separation or connection between the fixed connection part 10A and the movable eccentric unit 10B to drive the first sliding unit 2 slide independently or the first and the second sliding units 2,3 slide together by the eccentric shaft 10. the control mechanism 7 comprises a coupling part 101 set on the end surface of the fixed connection part 10A and a matching part 102 set on one end of the movable eccentric unit 10B, the coupling part 101 and the matching part 102 is cooperated with each other as to control the action of connection or separation between the fixed connection part 10A and the movable eccentric unit 10B when the coupling part 101 is coupled with the matching part 102 or detached from it, or a clutch can be set between the fixed connection part 10A and the movable eccentric unit 10B to achieve the same function as needed.

In particular, the control mechanism 7 is provided with a rotating part, a pivot part 73 which is movably connected to the movable eccentric unit 10B, and a spring 74, the rotating part includes a regulating disc 71 and a rotating sleeve 72 which is coupled to the regulating disc 71 and in cooperation with the rotation of the pivot part 73, the spring 74 is set between the movable eccentric unit 10B and the impeller 1; on the upper surface of the rotating sleeve 72 is disposed with a convex part 720 with guiding oblique surface 720A; a bone piece 730 set on the pivot part 73 is cooperated to the convex part 720, therein, the rotation of the rotating sleeve 72 drives bone piece 730 rotate from the place of end surface of the rotating sleeve 72 to the top surface of the convex part 720 along the guiding oblique surface 720A; conversely, rotation of the rotating sleeve 72 to its original place will activate the movable eccentric unit separate from the fixed connection part; in specified: By rotating the regulating disc 71 towards the first direction, rotating sleeve 72 jacks up the pivot part 73 to drive the movable eccentric unit 10B which is coupled with the pivot part 73 to displace towards the fixed connection part 10A, and by compressing the spring 74 is in purpose of pushing the coupling part connect with the matching part located on the movable eccentric unit 10B to urge the fixed connection part to rotate with the movable eccentric unit 10B synchronously, while rotating the regulating disc 71 towards the second direction, the spring rebound to its original place then result in pushing the pivot part reset and urge the coupling part to be separated from the matching part located on the movable eccentric unit 10B, under which consequence, the fixed connection part performs rotation meanwhile the movable eccentric unit 10B doesn't.

In specified embodiment, (referring to FIGS. 1~5), the water outlet device with different water outlet means of function of present invention comprises: impeller 1, spring 74, movable eccentric unit 10B, supporting plate 61, the first and the second sliding unit 2,3, stop rib 4, nozzle cover 62, pivot part 73, rotating sleeve 72, outlet cover 63, water outlet nozzle 5 and regulating disc 71.

Functional water outlet device, the impeller 1 is cooperated with the first and the second sliding unit 2,3 by the eccentric shaft 10 set on the impeller 1 penetrating the mid-hole of the supporting plate 61; the eccentric shaft 10 on the impeller 1 comprises two separating parts: a fixed connection part 10A and a movable eccentric unit 10B; the fixed connection part 10A which is provided with a coupling part 101 for matching assembly on its end surface is cooperated to the first sliding unit 2; the movable eccentric unit 10B which is provided with a matching part 102 corresponding to the coupling part 101 is cooperated to the second sliding unit 3; the fixed connection part 10A of the eccentric shaft 10 penetrates the location hole 20 in the middle of the first sliding unit 2, the longer side of the location hole 20 is set in vertical direction to the sliding direction. While the first sliding unit 2 coupled in the supporting plate 61 is urged to slide left and right repeatedly under the limitation of the stop rib 4 of the supporting plate 61; the matching part 102 of the movable eccentric unit 10B is cooperated to the coupling part 101 of the fixed connection part 10A, and the movable eccentric unit 10B is controlled to be connected with or dispatch from the fixed connection part 10A of impeller 1 under the effect of the spring 74, a location hole 30 in the middle of the second sliding unit 3 is cooperated to the movable eccentric unit 10B, the longer side of the location hole 30 is set in vertical direction to the sliding direction. While the second sliding unit 3 coupled in the nozzle cover 62 is urged to slide forward and backward repeatedly under the limitation of the stop rib 4 of the nozzle cover 62; wherein every water outlet nozzle 5 is coupled in the apertures opened both on the outlet cover 63 and on the the nozzle outlet 62 correspondingly, while the outlet hole 5B of the water outlet nozzle 5 goes through the apertures opened on the outlet cover 63, the inlet hole 5A of the water outlet nozzle 5 is disposed with two connecting sleeve 52,53 which are movably connected in the sliding groove 21,31 of the sliding units 2,3 respectively, a swinging portion with the spherical surface 51 is formed in the middle of the water outlet nozzle 5, the swinging portion is located between the nozzle cover 62 and outlet cover 63 in the manner of free rotation in omni-direction corresponding to the spherical surface.

The control mechanism 7, (the present invention takes the example of the mechanism in the switch manner by rotation, but also the mechanism can be designed by the way of button pushing or in the method of pulling or pushing control, the present invention choose the design of rotation switching mechanism preferably but not limited to this just in the consideration of the respect of weight of product for the target of thin and light) comprises a regulating disc 71 with its extending part from bottom side penetrating the mid-hole of the outlet cover 73, and making the regulating disc 71 assembly with rotating sleeve 72, a pivot part 73 is coupled in the mid-hole of the nozzle cover 63, the pivot part 73 only can take movement of up and down by the limitation of the bone piece 730 set on the sidewall of the pivot part 73, the bone piece 730 is cooperated to the guiding oblique surface 720A on the convex part 720 of the rotating sleeve 72, when the bone piece 730 is positioned a stagger angle with the guiding oblique surface 720A on the convex part 720, there is no displacement between the pivot part 73 and the rotating sleeve 72; when the bone piece 730 is moved to the top surface of the convex part 720 along the guiding oblique surface 720A, there is a displacement with height of the oblique between the pivot part 73 and the rotating sleeve 72; therein when the bottom side of the movable eccentric unit 10B and the other side of the pivot part 73 is connected with each other, the movable eccentric unit 10B will disconnect from fixed connection part 10A of the impeller 1 by the effect of the spring 74 in the condition of no displacement of the pivot part 73; while in the condition of displacement made by the pivot part 73, the movable eccentric unit 10B will connect with the fixed connection part 10A of the impeller 1 by the effect of the spring 74; conversely, it will disconnect the movable eccentric unit from the fixed connection part of the impeller when the rotating sleeve rotates to its original place.

The operation process is as followed: (as figured in FIGS. 6-15) takes the example of the shower with the water outlet device of the present invention, setting a gradient water groove on the inlet end of the shower cavity, the impeller 1 is pushed to rotate under the impact of water, in the consequence of which the inner cavity of outlet cover 63 will be fully filled of water by the injection through the hollow part of the impeller 1, the distributing of water will be made by the water outlet nozzles 5.

By turning the regulating disc 71 to left, the fixed connection part 10A of the impeller 1 is disconnected with the matching part 102 of the movable eccentric unit 10B, with the rotation of the impeller 1, the fixed connection part 10A of the eccentric shaft 10 is coupled with the position hole 20 with the limitation of stop rib 4, then drives the first sliding unit 2 to slide left and right repeatedly; a position hole 20 is set in the middle of the first sliding unit 2, the longer side of the position hole 20 is vertical to the sliding direction, make ensure that the rotation of the fixed connection part 10A of the eccentric shaft 10 will urge the first sliding unit 2 to slide left and right; when the first sliding unit 2 slide with a left eccentric displacement, meanwhile the corresponding water outlet nozzle 5 is moving for the same displacement because the connecting sleeve 52 is movably coupled in the sliding groove 21 of the first sliding unit 2 with the same open direction as the position hole 20, the water outlet nozzle 5 only can rotate by a right angle around the spherical surface 51; when the first sliding unit 2 slide a right displacement, the water outlet nozzle 5 will rotate towards left with a certain angle; therefore, the water flow from inlet hole 5A and outlet hole 5B through the water outlet nozzle 5 with the cooperation of the left and right sliding movement of first sliding unit 2, the water outlet nozzle 5 will perform the spray function of left and right single pendulum massaging water outlet.

By turning the regulating disc 71 to right, the fixed connection part 10A of the impeller 1 is connected with the matching part 102 of the movable eccentric unit 10B, with the rotation of the impeller 1, the movable eccentric unit 10B rotate synchronously with the impeller 1 in eccentric way, then drive the sliding units 2,3 to slide in repeated circumferential displacement of left and right, forward and backward. In the middle of the second sliding unit 3 is disposed with a position hole 30 crossed with the first sliding unit 2, the longer side of the position hole 30 is vertical to the sliding direction, make ensure that the eccentric shaft 10 drive the movable eccentric unit 10B rotate meanwhile urge the second sliding unit 3 to slide up and down; due to setting of the first sliding 2 and the second sliding 3 in staggered way, the eccentric shaft 10 rotates towards four different direction, in the consequence of which the water outlet nozzle 5 spray the water in four direction around the spherical surface 51; when the eccentric shaft 10 rotates in 90 degree angle starting from the left to the up side, the moving trajectory of the first sliding unit 2 is from the maximum to the minimum eccentric value in linear transition way to make the water outlet nozzle 5 rotate around the center from the left side; meanwhile, the moving condition of the second sliding unit 3 is in opposite way as trajectory of the second sliding unit 3 is from the minimum to the maximum eccentric value to make the water outlet nozzle 5 rotate from the center towards the up side, the combination of the two moving trajectory makes the water outlet nozzle 5 rotate in quarter of circular arc, thus when the eccentric shaft 10 rotate in a full circle to make a circular trajectory around the swing portion 51, the water outlet nozzle 5 will rotate circumferentially to form a rotating massage water spray when the water go through the water outlet nozzle 5.

Figure 6:
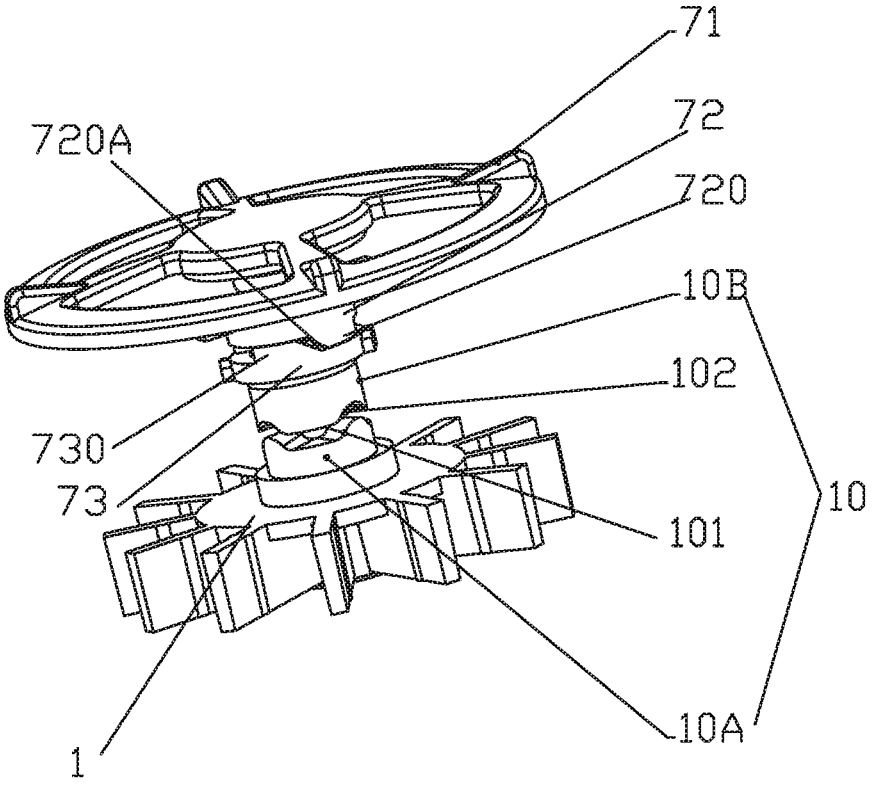
FIG. 6 illustrates a schematic diagram of a control mechanism of the present invention.
Figure 7:
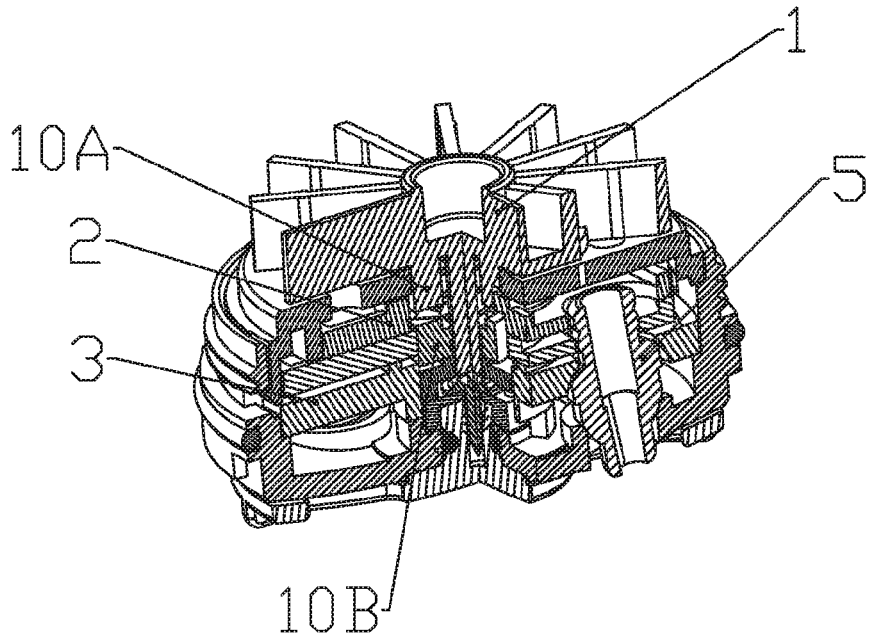
FIG. 7 illustrates a sectional and schematic diagram of the single swinging massage outlet function of the present invention.
Figure 8:
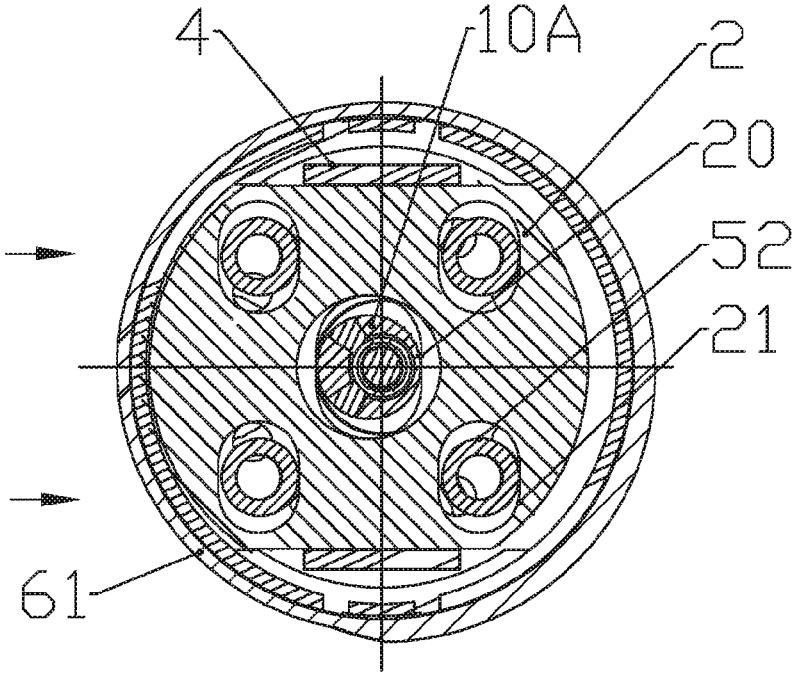
FIG. 8 illustrates one of a sectional diagram of the single swinging massage outlet function of the present invention.
Figure 9:
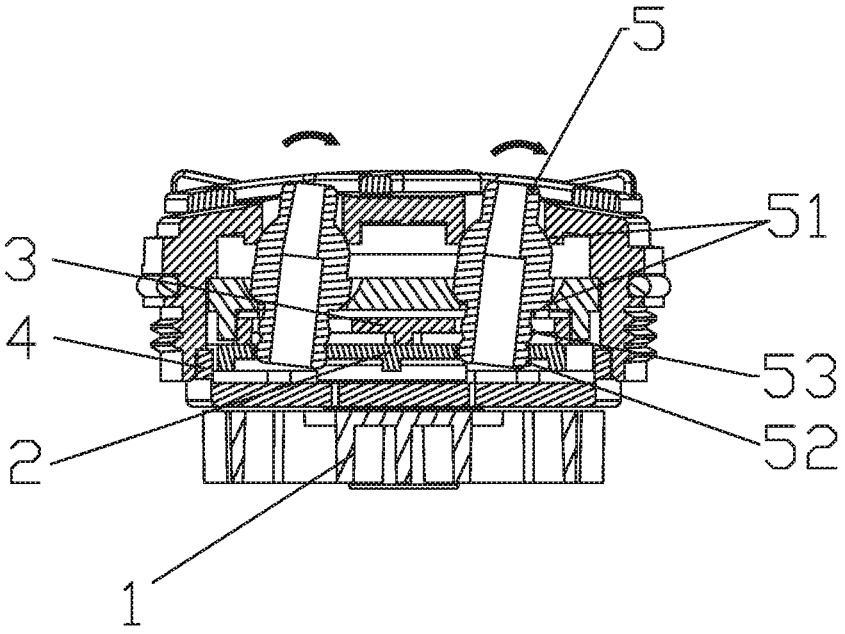
FIG. 9 illustrates another of a sectional diagram of the single swinging massage outlet function of the present invention.
Figure 10:
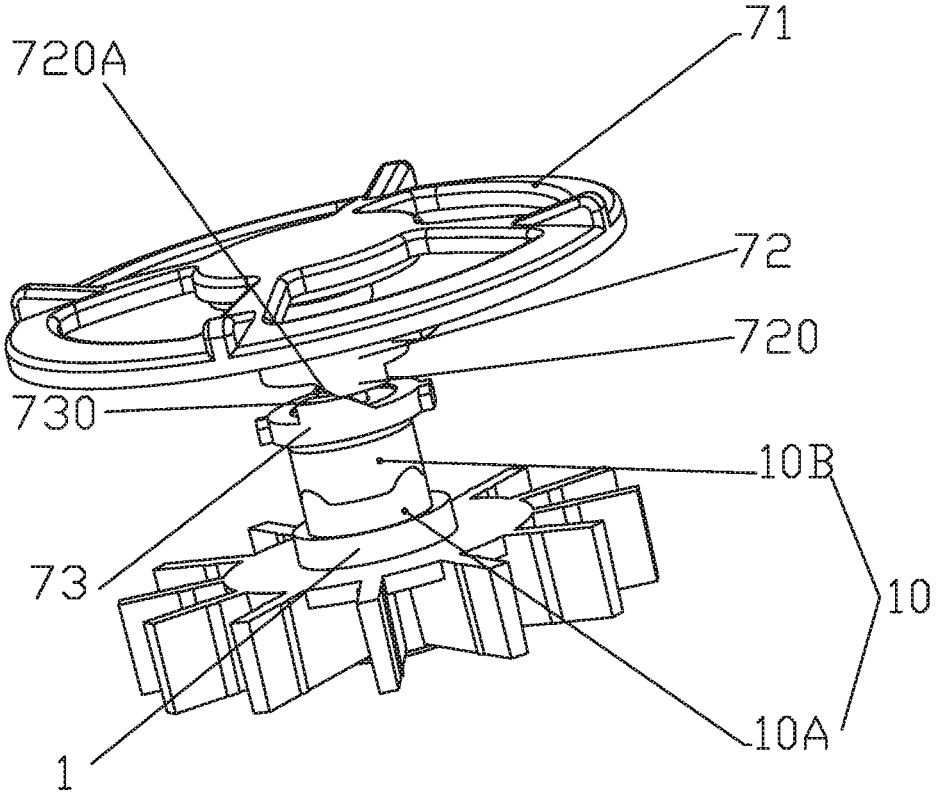
FIG. 10 illustrates another schematic diagram of the control mechanism of the present invention.
Figure 11:
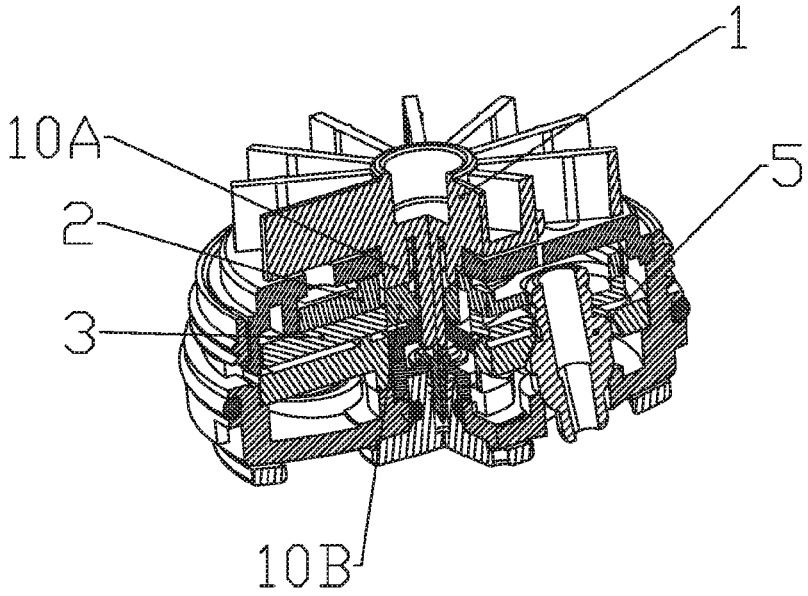
FIG. 11 illustrates an exploded and sectional diagram of the 360 degree massage spray of water outlet of the present invention.
Figure 12:
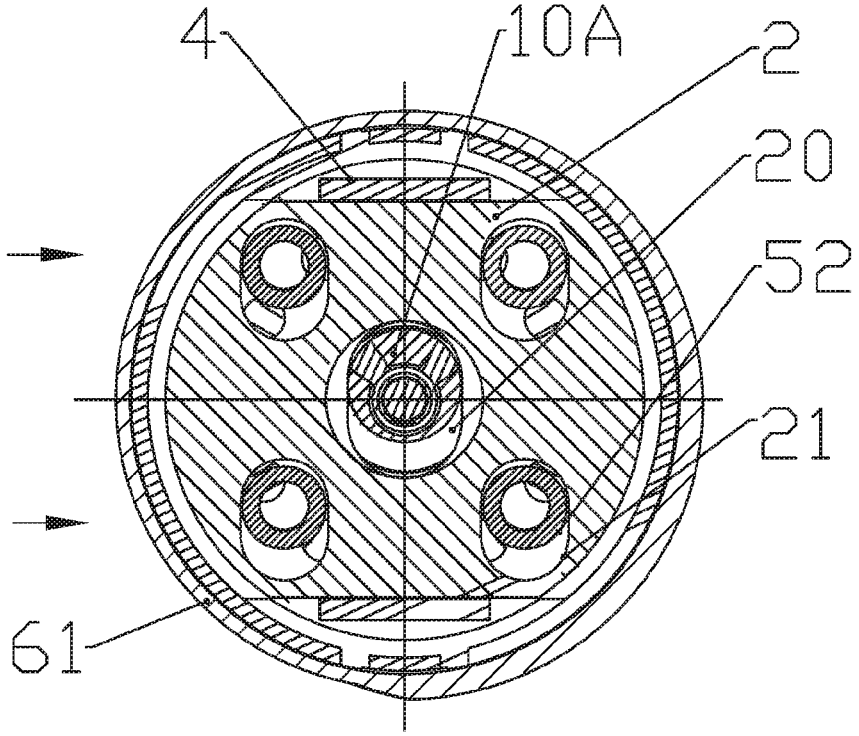
FIG. 12 illustrates one of a sectional diagram of the 360 degree massage spray of water outlet of the present invention.
Figure 13:
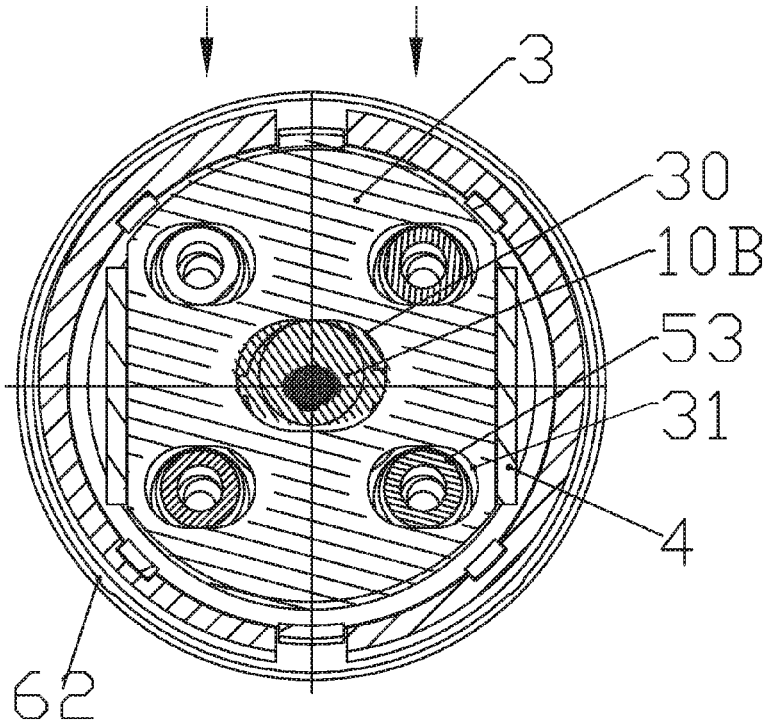
FIG. 13 illustrates another of sectional diagram of 360 degree massage spray of water outlet of the present invention.
Figure 14:
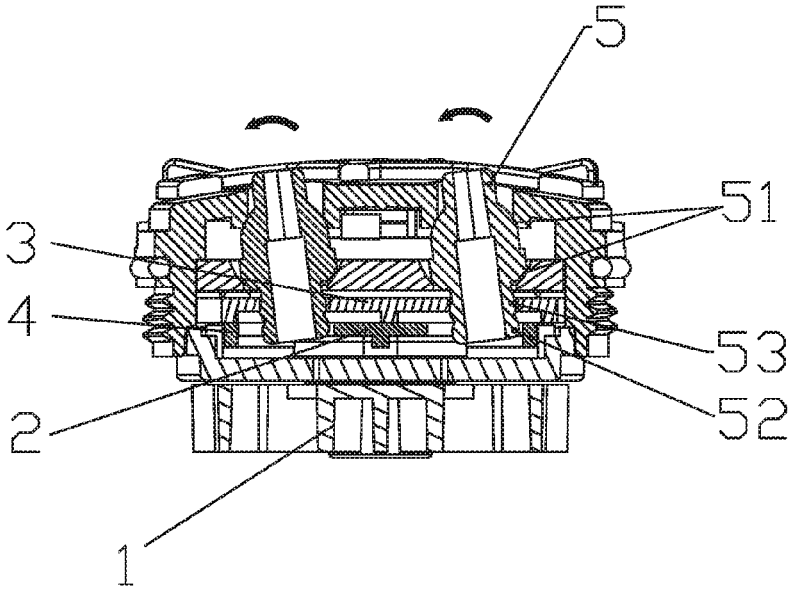
FIG. 14 illustrates third of sectional diagram of 360 degree massage spray of water outlet of the present invention.
Figure 15:
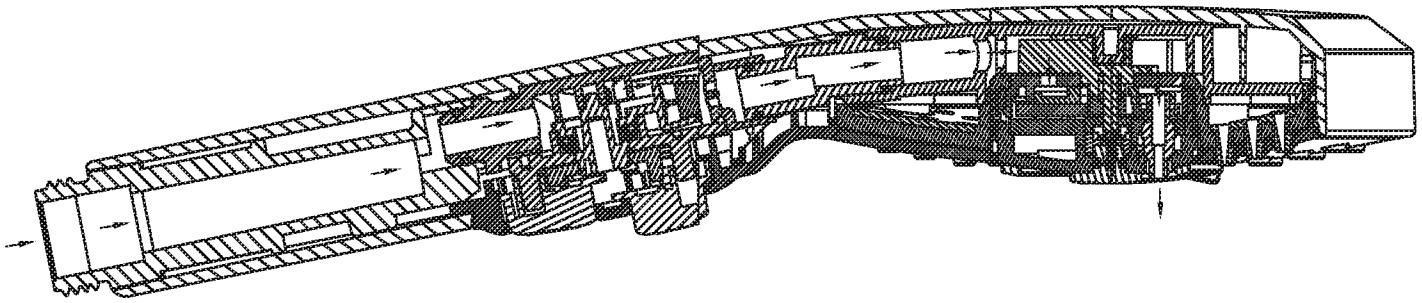
FIG. 15 illustrates a sectional diagram of the present invention assembled to a shower.
Figure 16:
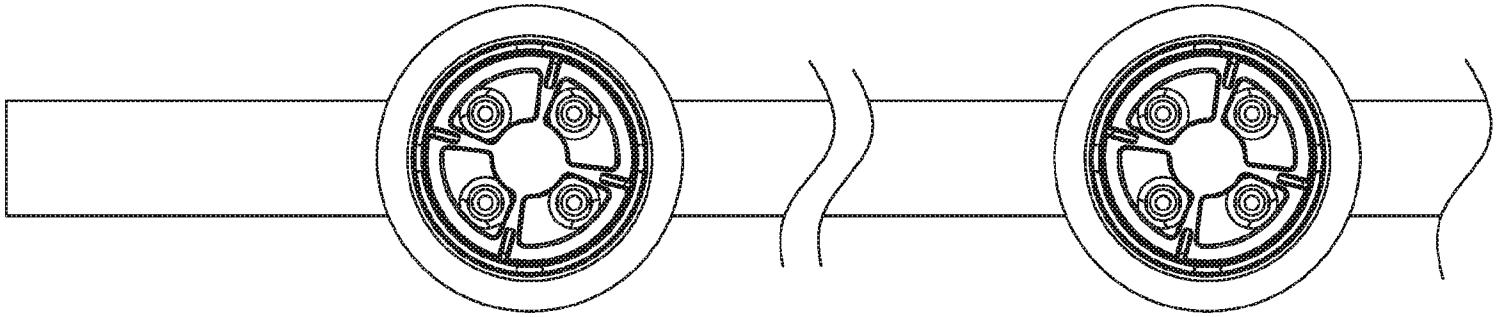
FIG. 16 illustrates a schematic diagram of the present invention assembled to a waist shower head.

Concluded as above, two means of water outlet function can be accomplished by controlling the rotation angle of the regulating disc in switch way as required; it's convenient and practical to use; this device can be set in the outlet cover of a shower to make a multi-functional shower of two outlet spray methods by control, or can be assembled to other products particularly for waist shower; (as FIG. 6 shown) the functional effect of the traditional waist shower is simplex due to the limited space of the waist shower, but now this waist shower composed of the outlet device of the present invention can meet the requirement of two functional outlet effect as well as design of compact structure compared to the traditional one.

Present invention of two staggered sliding units setting in purpose of driving the eccentric shaft rotate to accomplish the function of massage water spray with 360 degree rotation, that is with small volume and simple structure characterized with advantages of space-saving for multi-functional outlet compared to the traditional structure, and also can accomplish the function of simple pendulum massaging water outlet in the same time by control of the control mechanism, it's s break-through compared to the traditional design of achieving one function by same kind or same group of outlet nozzles, the different outlet function can be achieved by the same kind of outlet nozzle for space-saving by the design of a fine and ingenious structure; meanwhile, it's capable of choosing one of the outlet function between rotation massage effect or simple pendulum massage effect through the control mechanism, it's convenient and practical by easy operation and with promising prospect of future market; the present invention is simple in structure, easy to realize, and a large cost savings compared with the prior conventional structure, at the same time, the design of present invention can provide a relatively large space for other functions being implemented and further development of the product, not only to solve the technical problem of achieving 360 degree rotation spray of the massage shower to cater for the developing trend of existing market, but also break up the limitation generated by existing single water outlet function as well as with high market value and market prospect.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A water outlet device with rotary outlet function, comprising:

a fixing part, a driving mechanism, two sliding units, and a plurality of water outlet nozzles, wherein the water outlet nozzles are movably connected to the fixing part, the sliding units are configured to slide with respect to the fixing part, the driving mechanism is configured to be driven by pressure from flowing water, the two sliding units are connected with the driving mechanism and configured to be driven by the driving mechanism to slide, and the sliding units overlap each other, and are connected with the water outlet nozzles such that the water outlet nozzles rotate around a rotating axis by the sliding of the sliding units.

2. The water outlet device with rotary outlet function according to claim 1, wherein the two sliding units include respective surfaces facing and in direct sliding contact with each other, each sliding unit has, for each water outlet nozzle, a corresponding opening in an upper portion of which the water outlet nozzle is movably assembled in the openings, and the two sliding units are driven to slide in different directions such that the water outlet nozzles are driven to rotate by the sliding of at least one of the two sliding units.

3. The water outlet device with rotary outlet function according to claim 1, wherein the fixing part is connected with an assembly structure, each water outlet nozzle has a spherical surface within the assembly structure to support the water outlet nozzles to rotate omnidirectionally.

4. The water outlet device with rotary outlet function according to claim 1, wherein the sliding units are arranged in parallel, and a direction in which one of the sliding units slides is perpendicular to a direction in which the other sliding unit slides.

5. The water outlet device with rotary outlet function according to claim 1, further comprising two pairs of stop ribs, wherein one of the pairs of the stop ribs is located on two opposite sides of one of the sliding units, and the other pair of the stop ribs is located on two opposite sides of the other sliding unit, the two pairs of stop ribs guiding the two sliding units to slide in different directions.

6. The water outlet device with rotary outlet function according to claim 1, wherein the driving mechanism comprises an impeller having an eccentric shaft penetrating the two sliding units and moveably connected with the sliding units, wherein under an impact of the flowing water, the rotation of the impeller drives the eccentric shaft to rotate, and thus driving the two sliding units to slide, and wherein each of the sliding units has a location hole in which the eccentric shaft is located.

7. A water outlet device with different water outlet functions, comprising:

a fixing part, a driving mechanism, two sliding units, a plurality of water outlet nozzles, and a control mechanism, wherein the water outlet nozzles are movably connected to the fixing part, the sliding units are configured to slide with respect to the fixing part, the driving mechanism is configured to be activated by flowing water, and the control mechanism is connected with the driving mechanism and the two sliding units to control how many of the sliding units slide, the sliding units are connected to the water outlet nozzles and are configured to drive the water outlet nozzles to move, thereby to generate different outlet functions based on whether one or both of the two sliding units are sliding.

8. The water outlet device with different water outlet function according to claim 7, wherein the control mechanism is configured to control one of the sliding units or both of the sliding units together to slide, the water outlet nozzles are activated to swing when one of the sliding units slides, and when the two sliding units slide in different directions, the water outlet nozzles are driven to rotate around a rotary axis by the sliding units.

9. The water outlet device with different water outlet functions according to claim 8, wherein each of the two sliding units includes a respective surface facing and in direct sliding contact with each other, each sliding unit has, for each water outlet nozzle, a corresponding opening in an upper portion of which the water outlet nozzle is movably assembled in the openings, and the two sliding units are driven to slide in different directions such that the water outlet nozzles are driven to rotate by the sliding of at least one of the two sliding units.

10. The water outlet device with different water outlet functions according to claim 9, wherein the fixing part is connected with an assembly structure, each water outlet nozzle has a spherical surface within the assembly structure to support the water outlet nozzles to rotate omnidirectionally, each water outlet nozzle has a nozzle body including an inlet hole and an outlet hole, the spherical surface is positioned in the middle of the nozzle body, and each water outlet nozzle has two connecting sleeves next to the inlet hole and connected to the two sliding units, respectively.

11. The water outlet device with different water outlet functions according to claim 7, wherein the sliding units are arranged in parallel, and a direction in which one of the sliding units slides is perpendicular to a direction in which the other sliding unit slides.

12. The water outlet device with different water outlet functions according to claim 7, further comprising two pairs of stop ribs, one of the pairs of the stop ribs being located on two opposite sides of one of the sliding units, the other pair of the stop ribs being located on two opposite sides of the other sliding unit, the two pairs of stop ribs guiding the two sliding units to slide in different directions.

13. The water outlet device with different water outlet functions according to claim 7, wherein the driving mechanism comprises an impeller having an eccentric shaft penetrating the two sliding units and moveably connected with the sliding units, under an impact of the flowing water, the rotation of the impeller drives the eccentric shaft to rotate, and thus driving the two sliding units to slide, and each of the sliding units has a location hole in which the eccentric shaft is located.

14. The water outlet device with different water outlet functions according to claim 13, wherein the eccentric shaft comprises a fixed connection part and a movable eccentric unit, which are detachably connected to each other and which are connected to the two sliding units, respectively, and the control mechanism is configured to separate the fixed connection part from the movable eccentric unit to drive one of the sliding units to slide alone or combine the fixed connection part with the movable eccentric unit to drive the two sliding units to slide together through the eccentric shaft.

15. The water outlet device with different water outlet functions according to claim 14, wherein the control mechanism comprises a coupling part disposed on an end surface of the fixed connection part and a matching part disposed on one end of the movable eccentric unit, and the coupling part and the matching part are detachably connected with each other to combine the fixed connection part with the movable eccentric unit when the coupling part is coupled with the matching part, or separate the fixed connection part from the movable eccentric unit when the coupling part is detached from the matching part, the control mechanism has a rotating part, a pivot part that is connected with the rotating part and the movable eccentric unit, and a spring sleeved between the movable eccentric unit and the impeller, the rotating part is configured for adjustment to move the pivot part to drive the movable eccentric unit into a displacement, that compresses the spring and pushes the coupling part to be connected with the matching part on the movable eccentric unit when the rotating part rotates in a first direction, and when the rotating part rotates in a second direction, the spring returns to its original place, resulting in the spring pushing the pivot part to be reset and driving the coupling part to be separated from the matching part, and an upper surface of the rotating part has a convex part with a guiding oblique surface, the pivot part having a piece inclined so as to match with the guiding oblique surface of the convex part.

16. The water outlet device with rotary outlet function according to claim 1, wherein the fixing part comprises an outlet cover and an inlet waterway connected to the water outlet nozzles, the fixing part having a supporting plate and a nozzle cover which are both located in the outlet cover, the supporting plate and the nozzle cover forming a cavity for accommodating the sliding units.

17. The water outlet device with different water outlet functions according to claim 8, wherein the fixing part comprises an outlet cover and an inlet waterway connected to the water outlet nozzles, the fixing part having a supporting plate and a nozzle cover which are both located in the outlet cover, the supporting plate and the nozzle cover forming a cavity for accommodating the sliding units.

* * * * *